US006742788B1

(12) United States Patent
Li et al.

(10) Patent No.: US 6,742,788 B1
(45) Date of Patent: Jun. 1, 2004

(54) REPLACEABLE SKATE ASSEMBLY

(75) Inventors: Zi-Yang Li, Taichung (TW); Wen-Qing Li, Taichung (TW)

(73) Assignee: Shan-Yuan Chan

( * ) Notice: Subject to any disclaimer, the term of this patent is extended or adjusted under 35 U.S.C. 154(b) by 67 days.

(21) Appl. No.: 10/251,871

(22) Filed: Sep. 17, 2002

(51) Int. Cl.[7] ..... A63C 17/06

(52) U.S. Cl. ..... 280/11.221; 280/11.27; 280/11.3; 280/11.33

(58) Field of Search ..... 280/11.221, 11.231, 280/11.27, 11.28, 11.3, 11.31, 11.33, 623, 625, 11.12, 7.13

(56) References Cited

U.S. PATENT DOCUMENTS 2,998,260 A * 8/1961 Meyer ..... 280/7.13
5,887,877 A * 3/1999 Nero ..... 280/11.221
5,895,061 A * 4/1999 Gignoux ..... 280/11.214
6,015,156 A * 1/2000 Pratt ..... 280/11.224
6,120,038 A * 9/2000 Dong et al. ..... 280/7.13
6,145,853 A * 11/2000 Croshaw ..... 280/11.221
6,164,669 A * 12/2000 Svensson ..... 280/11.3
6,270,089 B1 * 8/2001 Marechal ..... 280/11.3
6,334,621 B1 * 1/2002 Chang ..... 280/11.3
6,382,638 B1 * 5/2002 Lee ..... 280/7.13
6,572,121 B2 * 6/2003 Shih ..... 280/11.33
2003/0127830 A1 * 7/2003 Chang et al. ..... 280/607
2003/0155724 A1 * 8/2003 Wang et al. ..... 280/11.3
2003/0201614 A1 * 10/2003 Chi ..... 280/11.3

* cited by examiner

*Primary Examiner*—Brian L. Johnson
*Assistant Examiner*—Jeffrey Restifo

(57) ABSTRACT

A replaceable skate assembly includes a boot, a base mounted on a bottom of the boot, and a locking device mounted in the base. The locking device includes a positioning rod, a locking pawl, and a spring. Thus, the base may be assembled on and detached from the bottom of the boot quickly, easily and conveniently, thereby facilitating the user using the replaceable skate assembly. In addition, the bottom of the boot is integrally formed with the boot, without having to additionally provide an aluminum alloy structure on the bottom of the boot, thereby simplifying the procedure of fabrication, and thereby decreasing the cost of fabrication.

11 Claims, 5 Drawing Sheets

REPLACEABLE SKATE ASSEMBLY

BACKGROUND OF THE INVENTION

1. Field of the Invention

The present invention relates to a replaceable skate assembly, and more particularly to a replaceable skate assembly, wherein the base may be assembled on and detached from the bottom of the boot quickly, easily and conveniently, thereby facilitating the user using the replaceable skate assembly.

2. Description of the Related Art

A conventional replaceable skate assembly 5 in accordance with the prior art shown in FIG. 6 comprises a boot 51, and a base 52 mounted on the bottom of the boot 51. The bottom of the boot 51 is provided with an aluminum alloy structure which is formed with two recesses 511 each protruded with an insertion tenon 512 which has a side face formed with an insertion hole 513. The base 52 is provided with two mounting seats 521 each mounted in one of the two recesses 511 of the boot 51. Each of the two mounting seats 521 is provided with a receiving chamber 522 for receiving the insertion tenon 512. The receiving chamber 522 has a side face formed with a through hole 5220 aligning with the insertion hole 513 of the insertion tenon 512. Each of the two mounting seats 521 is also provided with a catch plate 523 formed with a through hole 5230. Each of the two mounting seats 521 is also provided with a safety pin 524, a spring 525 and a bent bar 526 mounted between the receiving chamber 522 and the catch plate 523.

In operation, the user may operate the bent bar 526 to move the safety pin 524, so that the safety pin 524 may be inserted into and detached from the insertion hole 513 of the insertion tenon 512 of the boot 51 by the elastic action of the spring 525. Thus, the base 52 may be mounted on or detached from the bottom of the boot 51 according to the user's requirements.

However, when the base 52 is mounted on the bottom of the boot 51, the safety pin 524 cannot align with the insertion hole 513 of the insertion tenon 512 of the boot 51 easily, so that the base 52 cannot be mounted on the bottom of the boot 51 easily and conveniently. In addition, it is necessary to additionally provide an aluminum alloy structure on the bottom of the boot 51, thereby complicating the procedure of fabrication, and thereby increasing the cost of fabrication.

SUMMARY OF THE INVENTION

The present invention has arisen to mitigate and/or obviate the disadvantage of the conventional replaceable skate assembly.

The primary objective of the present invention is to provide a replaceable skate assembly, wherein the base may be assembled on and detached from the bottom of the boot quickly, easily and conveniently, thereby facilitating the user using the replaceable skate assembly.

Another objective of the present invention is to provide a replaceable skate assembly, wherein the bottom of the boot is integrally formed with the boot, without having to additionally provide an aluminum alloy structure on the bottom of the boot, thereby simplifying the procedure of fabrication, and thereby decreasing the cost of fabrication.

In accordance with the present invention, there is provided a replaceable skate assembly, comprising a boot, a base mounted on a bottom of the boot, and a locking device mounted in the base, wherein:

the bottom of the boot has a first end formed with a locking recess and a second end formed with a connecting recess, the connecting recess of the boot has a side formed with a locking cavity;

the base has a first end provided with a first mounting seat and a second end provided with a second mounting seat, the first mounting seat of the base has a top provided with a locking block that may be locked in the locking recess of the boot, the second mounting seat of the base has a top provided with a mounting block that may be received in the connecting recess of the boot, the mounting block of the second mounting seat of the base has an inside formed with a closed receiving space which has a side formed with a square hole and a bottom formed with a through hole, the second mounting seat of the base has a bottom provided with a first positioning plate formed with a through hole and a second positioning plate formed with a through hole; and the locking device includes a positioning rod, a locking pawl, and a spring, wherein:

the locking pawl is movably mounted in the receiving space of the mounting block of the second mounting seat of the base, and has a top end provided with a wedge-shaped catch block received in and protruded outward from the square hole of the receiving space of the mounting block of the second mounting seat of the base; and the positioning rod is in turn extended through the through hole of the first positioning plate of the second mounting seat of the base, the locking pawl, the spring, the through hole of the second positioning plate of the second mounting seat of the base, and is protruded outward from the base.

Further benefits and advantages of the present invention will become apparent after a careful reading of the detailed description with appropriate reference to the accompanying drawings.

DETAILED DESCRIPTION OF THE INVENTION

Figure 1:
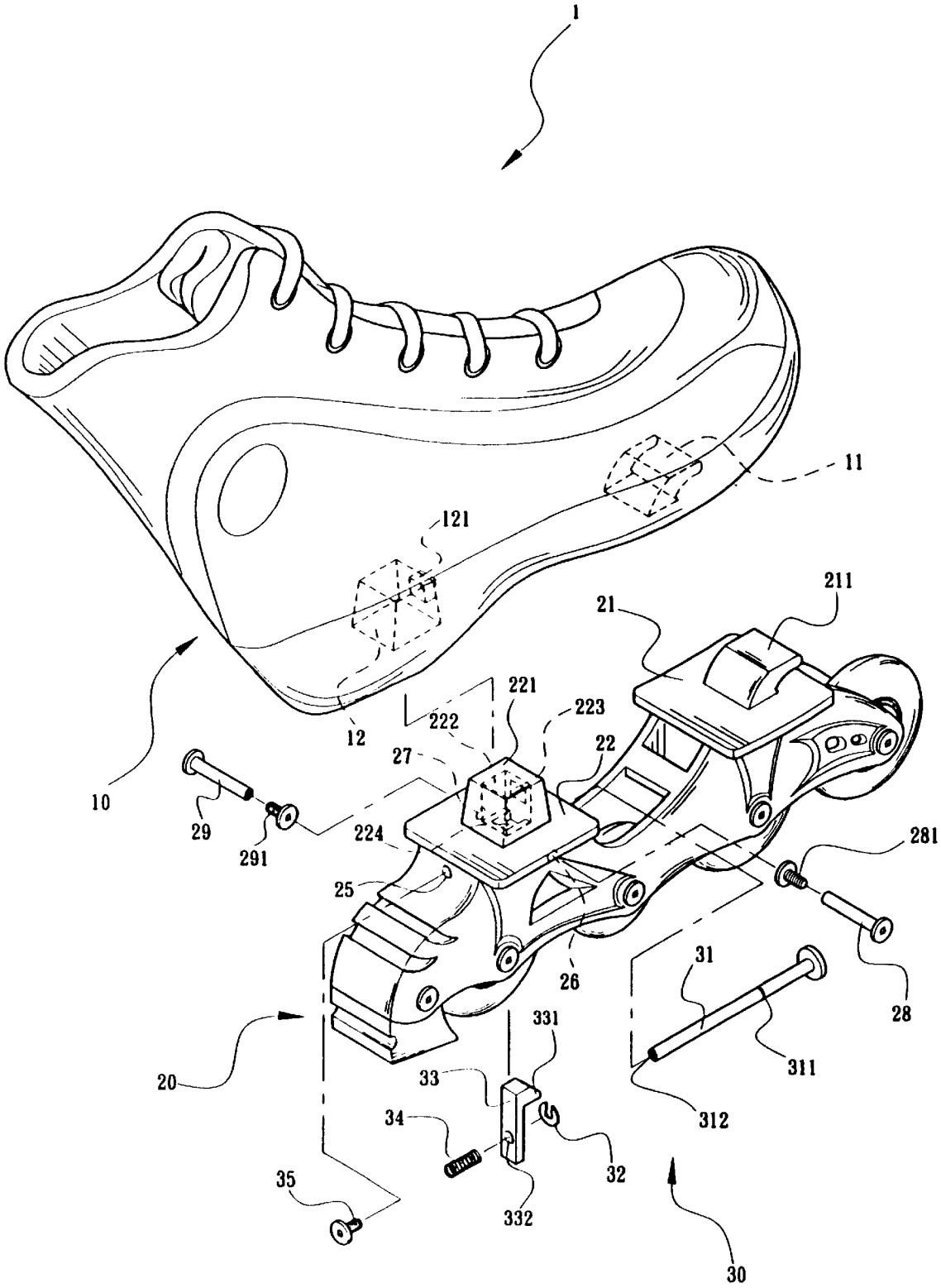
FIG. 1 is an exploded perspective view of a replaceable skate assembly in accordance with a preferred embodiment of the present invention.
Figure 2:
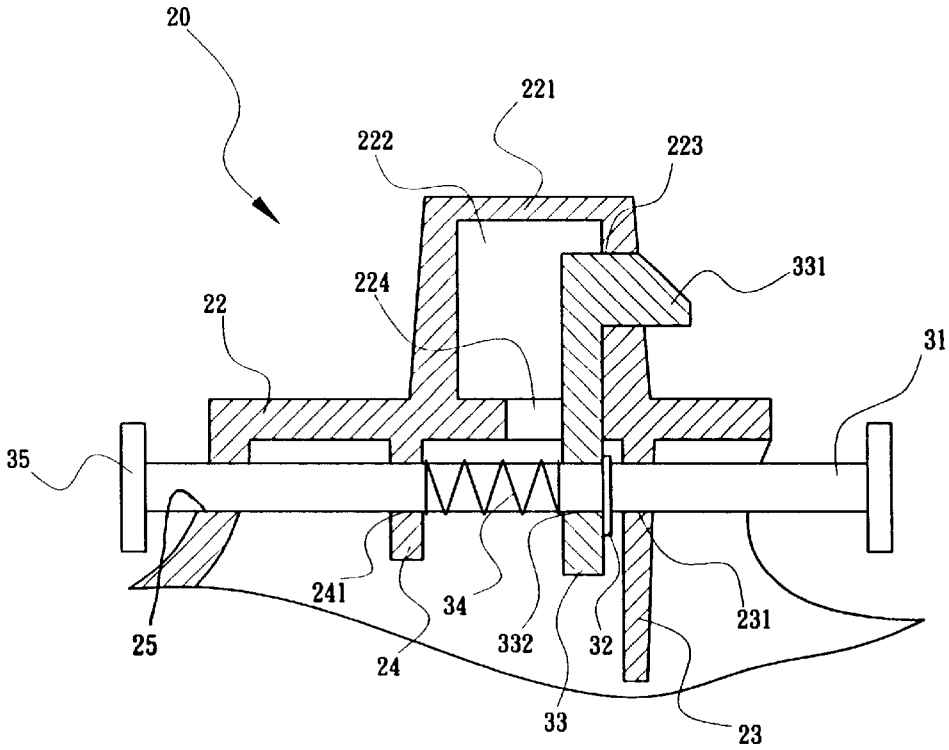
FIG. 2 is a partially side plan cross-sectional assembly view of the replaceable skate assembly as shown in FIG. 1.

Referring to the drawings and initially to FIGS. 1 and 2, a replaceable skate assembly 1 in accordance with a preferred embodiment of the present invention comprises a boot 10, a base 20 mounted on the bottom of the boot 10, and a locking device 30 mounted in the base 20.

The bottom of the boot 10 is integrally formed with the boot 10. The bottom of the boot 10 has a first end formed with a locking recess 11 and a second end formed with a connecting recess 12. The connecting recess 12 of the boot 10 has a side formed with a locking cavity 121.

The base 20 is available for a skate, such as an ice skate, a roller skate, an in-line roller skate or the like. The base 20 may be directly mounted on the bottom of the boot 10. The base 20 has a first end provided with a first mounting seat 21 and a second end provided with a second mounting seat 22. The first mounting seat 21 of the base 20 has a top provided with a locking block 211 that may be locked in the locking recess 11 of the boot 10.

The second mounting seat 22 of the base 20 has a top provided with a mounting block 221 that may be received in the connecting recess 12 of the boot 10. The mounting block 221 of the second mounting seat 22 of the base 20 has an inside formed with a closed receiving space 222 which has a side formed with a square hole 223 and a bottom formed with a through hole 224. The second mounting seat 22 of the base 20 has a bottom provided with a first positioning plate 23 formed with a through hole 231 and a second positioning plate 24 formed with a through hole 241. The through hole 224 of the receiving space 222 of the mounting block 221 of the second mounting seat 22 of the base 20 is located between the first positioning plate 23 and the second positioning plate 24 of the second mounting seat 22 of the base 20.

The second end of the base 20 is formed with a circular hole 25 aligning with the through hole 241 of the second positioning plate 24 of the second mounting seat 22 of the base 20. The second mounting seat 22 of the base 20 has a first side formed with a through hole 26 for passage of a bolt 28 and a screw 281, and a second side formed with a through hole 27 for passage of a bolt 29 and a screw 291.

The locking device 30 is mounted between the first positioning plate 23 and the second positioning plate 24 of the second mounting seat 22 of the base 20, and includes a positioning rod 31, a C-shaped snap ring 32, an inverted L-shaped locking pawl 33, a spring 34, and a screw 35. The positioning rod 31 has a first end formed with an annular groove 311 and a second end formed with a screw bore 312. The locking pawl 33 has a top end provided with a wedge-shaped catch block 331 extended outward, and has a lower portion formed with a through hole 332. The spring 34 is mounted on the positioning rod 31, and is urged between the first positioning plate 23 and the second positioning plate 24 of the second mounting seat 22 of the base 20.

In assembly, the locking pawl 33 is extended through the through hole 224 into the receiving space 222 of the mounting block 221 of the second mounting seat 22 of the base 20, with the wedge-shaped catch block 331 of the locking pawl 33 being received in and protruded outward from the square hole 223 of the receiving space 222 of the mounting block 221 of the second mounting seat 22 of the base 20. Then, the positioning rod 31 is in turn extended through the through hole 231 of the first positioning plate 23 of the second mounting seat 22 of the base 20, the through hole 332 of the locking pawl 33, the spring 34, the through hole 241 of the second positioning plate 24 of the second mounting seat 22 of the base 20 and the circular hole 25 of the base 20, and is protruded outward from the circular hole 25 of the base 20. Then, the screw 35 is screwed into the screw bore 312 of the positioning rod 31. Then, the C-shaped snap ring 32 is secured in the annular groove 311 of the positioning rod 31, and is located between the locking pawl 33 and the first positioning plate 23 of the second mounting seat 22 of the base 20, thereby accomplishing assembly of the locking device 30.

By such a design, the locking device 30 may co-operate with the mounting block 221 of the second mounting seat 22 of the base 20 to form a locking fit with the locking cavity 121 of the connecting recess 12 of the boot 10.

Figure 3:
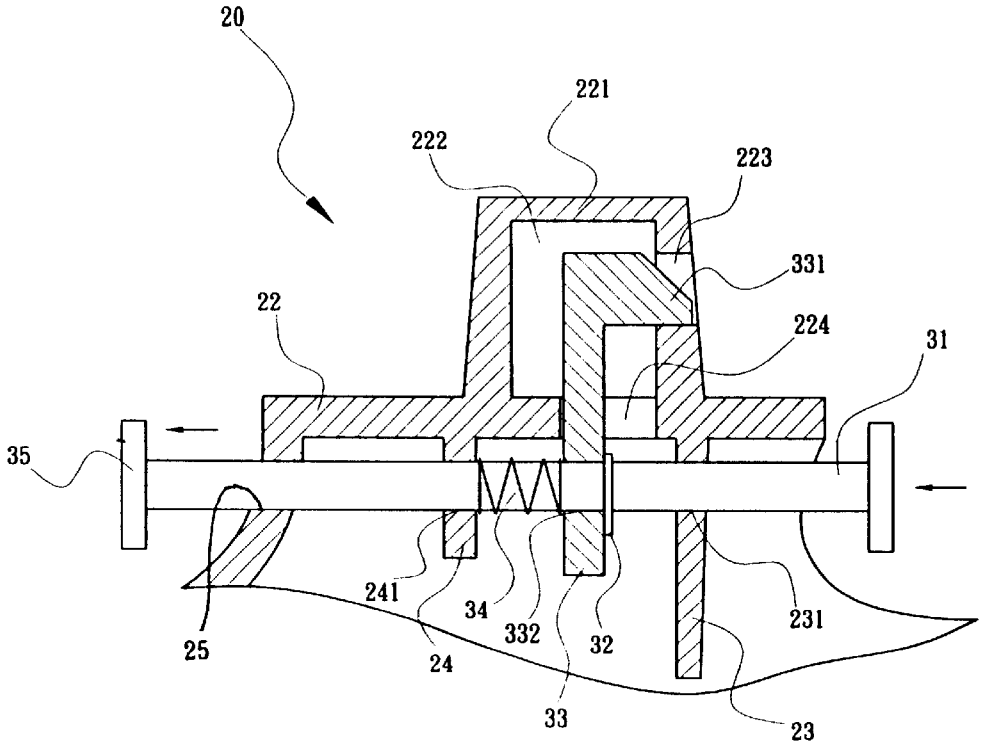
FIG. 3 is a schematic operational view of the replaceable skate assembly as shown in FIG. 2 in assembly.
Figure 4:
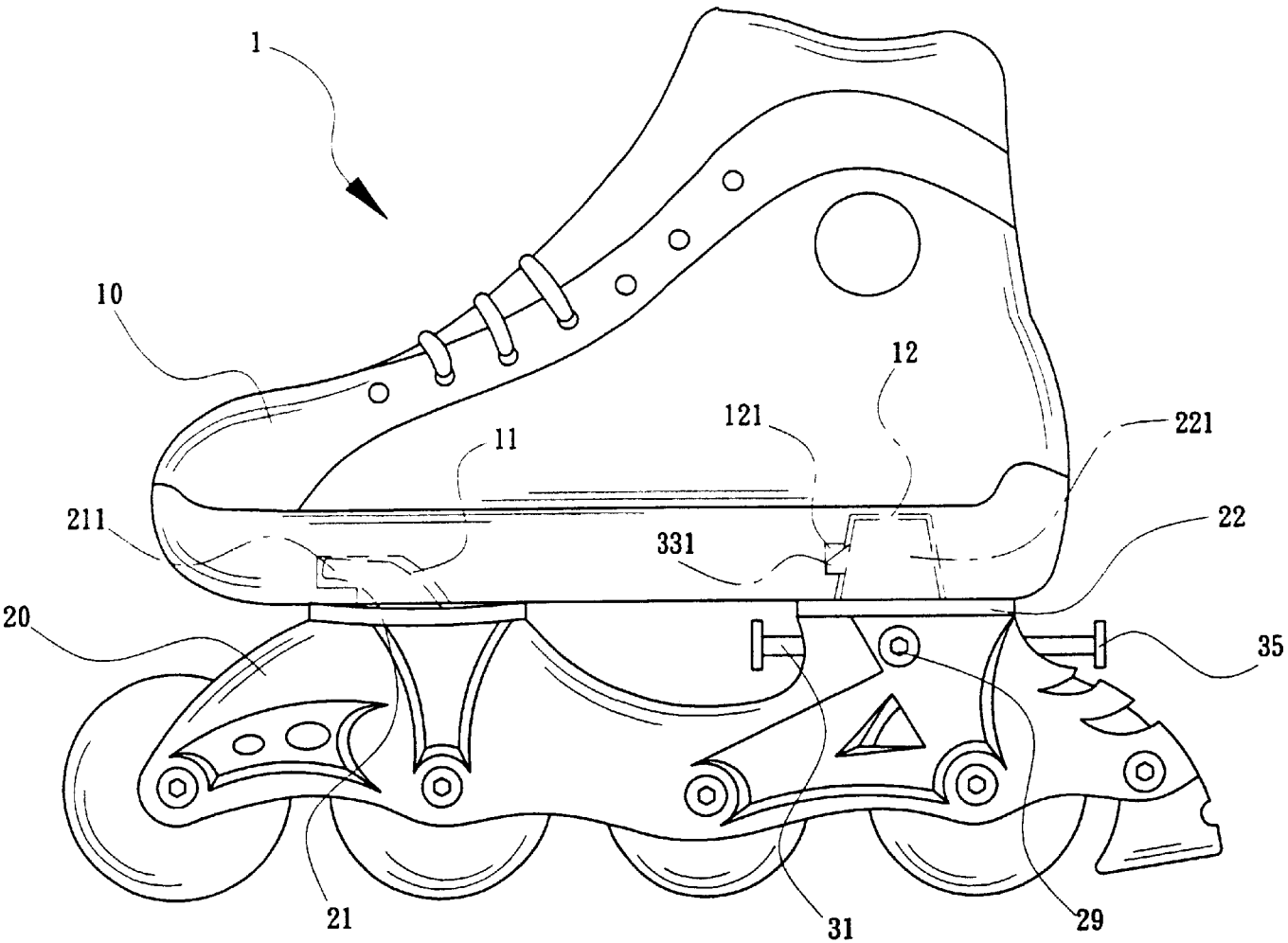
FIG. 4 is a side plan assembly view of the replaceable skate assembly as shown in FIG. 1.

In operation, referring to FIGS. 2–4 with reference to FIG. 1, the locking block 211 of the first mounting seat 21 of the base 20 may be locked in the locking recess 11 of the boot 10, while the mounting block 221 of the second mounting seat 22 of the base 20 may be received in the connecting recess 12 of the boot 10. At this time, by the design of the inclined surface of the wedge-shaped catch block 331 of the locking pawl 33 and by the elasticity of the spring 34, the wedge-shaped catch block 331 of the locking pawl 33 may be forced into the locking cavity 121 of the connecting recess 12 of the boot 10, thereby locking the mounting block 221 of the second mounting seat 22 of the base 20 in the connecting recess 12 of the boot 10, so that the base 20 may be mounted and fixed on the bottom of the boot 10 as shown in FIG. 4.

On the contrary, the user may push the positioning rod 31 or pull the screw 35 to move the locking pawl 33 which may be moved from the position as shown in FIG. 2 to the position as shown in FIG. 3, thereby detaching the wedge-shaped catch block 331 of the locking pawl 33 from the locking cavity 121 of the connecting recess 12 of the boot 10, so that the base 20 may be detached from the bottom of the boot 10. Then, the locking pawl 33 may be returned to the original position by the restoring force of the spring 34.

Figure 5:
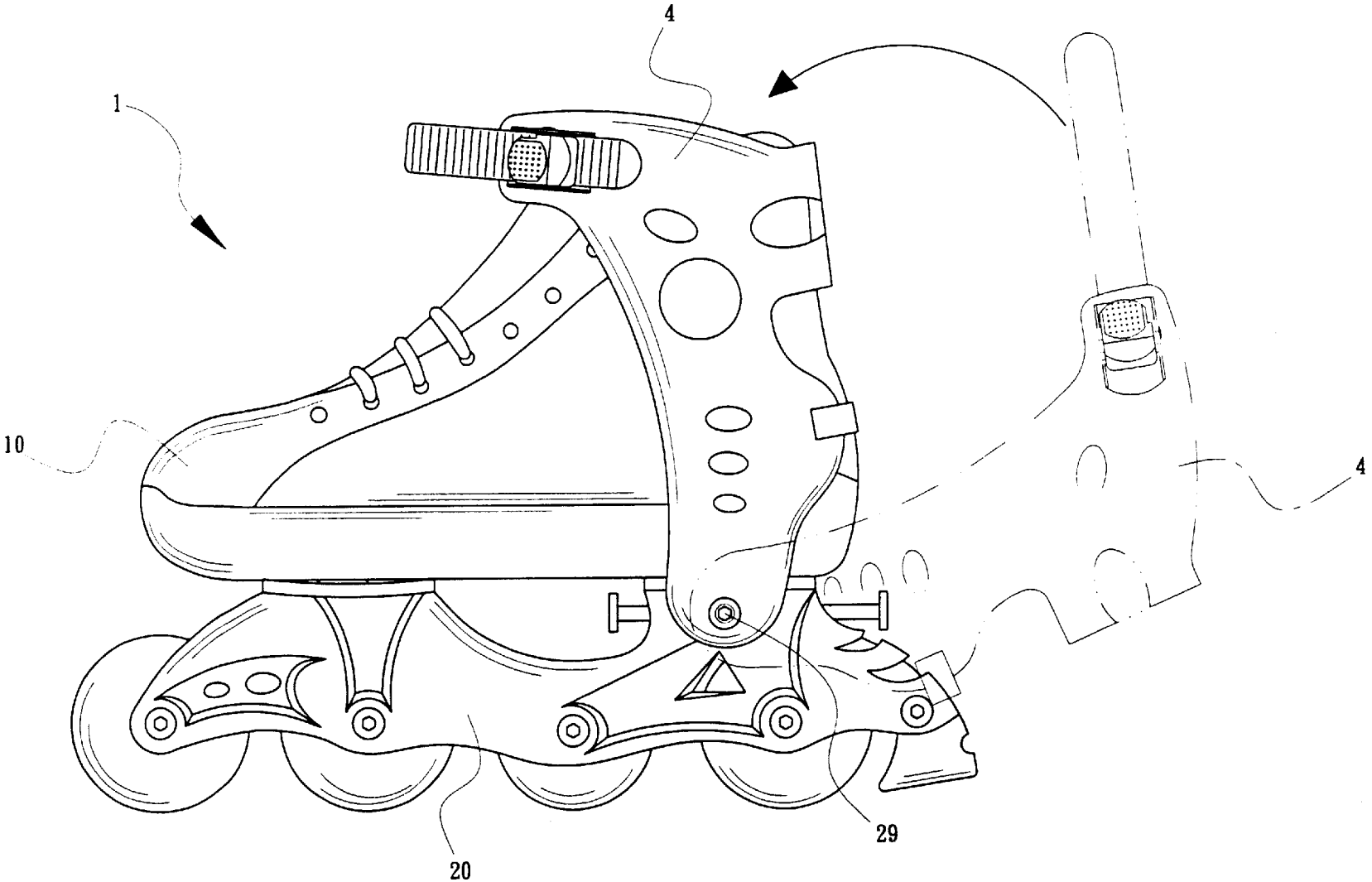
FIG. 5 is a side plan assembly view of the replaceable skate assembly in accordance with another embodiment of the present invention.
Figure 6:
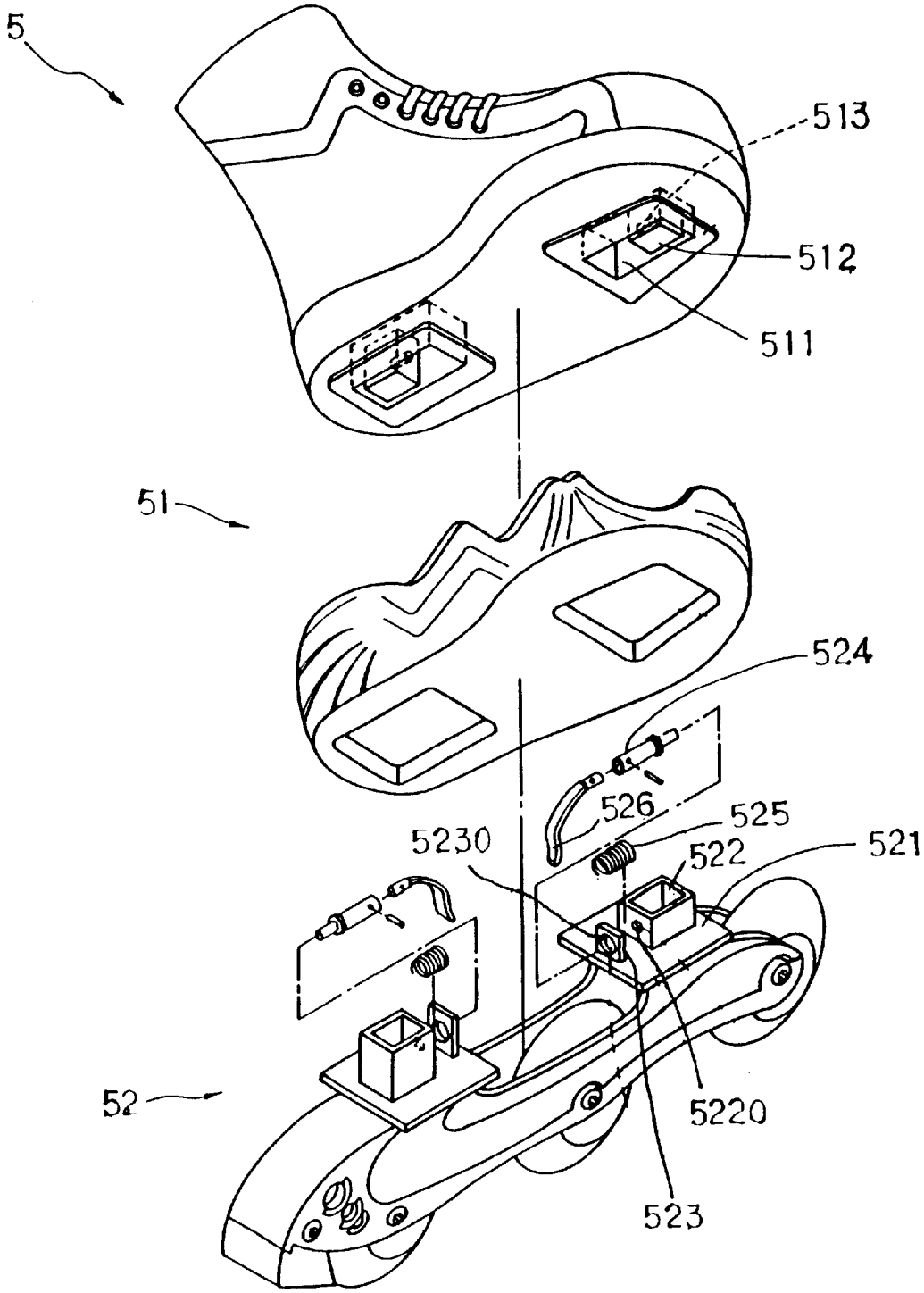
FIG. 6 PRIOR ART
FIG. 6 is an exploded perspective view of a conventional replaceable skate assembly in accordance with the prior art.

Referring to FIG. 5 with reference to FIG. 1, the replaceable skate assembly 1 in accordance with another embodiment of the present invention further comprises an ankle guard 4 that may be mounted on the second mounting seat 22 of the base 20 by the through hole 26 for passage of the bolt 28 and the screw 281, and the through hole 27 for passage of the bolt 29 and the screw 291, so that the ankle guard 4 may be locked on the second mounting seat 22 of the base 20.

Accordingly, the replaceable skate assembly 1 in accordance with the present invention has the following advantages.

1. The base 20 may be assembled on and detached from the bottom of the boot 10 quickly, easily and conveniently, thereby facilitating the user using the replaceable skate assembly 1.

2. The bottom of the boot 10 is integrally formed with the boot 10, without having to additionally provide an aluminum alloy structure on the bottom of the boot 10, thereby simplifying the procedure of fabrication, and thereby decreasing the cost of fabrication.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A replaceable skate assembly, comprising a boot, a base mounted on a bottom of the boot, and a locking device mounted in the base, wherein:

the bottom of the boot has a first end formed with a locking recess and a second end formed with a connecting recess, the connecting recess of the boot has a side formed with a locking cavity;

the base has a first end provided with a first mounting seat and a second end provided with a second mounting seat, the first mounting seat of the base has a top provided with a locking block that may be locked in the locking recess of the boot, the second mounting seat of the base has a top provided with a mounting block that may be received in the connecting recess of the boot, the mounting block of the second mounting seat of the base has an inside formed with a closed receiving space which has a side formed with a square hole and a bottom formed with a through hole, the second mounting seat of the base has a bottom provided with a first positioning plate formed with a through hole and a second positioning plate formed with a through hole; and the locking device includes a positioning rod, a locking pawl, and a spring, wherein:

the locking pawl is movably mounted in the receiving space of the mounting block of the second mounting seat of the base, and has a top end provided with a wedge-shaped catch block received in and protruded outward from the square hole of the receiving space of the mounting block of the second mounting seat of the base; and the positioning rod is in turn extended through the through hole of the first positioning plate of the second mounting seat of the base, the locking pawl, the spring, the through hole of the second positioning plate of the second mounting seat of the base, and is protruded outward from the base.

2. The replaceable skate assembly in accordance with claim 1, wherein the bottom of the boot is integrally formed with the boot.

3. The replaceable skate assembly in accordance with claim 1, wherein the through hole of the receiving space of the mounting block of the second mounting seat of the base is located between the first positioning plate and the second positioning plate of the second mounting seat of the base.

4. The replaceable skate assembly in accordance with claim 1, wherein the second end of the base is formed with a circular hole aligning with the through hole of the second positioning plate of the second mounting seat of the base for passage of the positioning rod of the locking device.

5. The replaceable skate assembly in accordance with claim 1, wherein the second mounting seat of the base has a first side formed with a through hole for passage of a bolt and a screw, and a second side formed with a through hole for passage of a bolt and a screw.

6. The replaceable skate assembly in accordance with claim 5, wherein further comprising an ankle guard mounted on the second mounting seat of the base by the through hole of the first side for passage of the bolt and the screw, and the through hole of the second side for passage of the bolt and the screw, so that the ankle guard may be locked on the second mounting seat of the base.

7. The replaceable skate assembly in accordance with claim 1, wherein the locking device is mounted between the first positioning plate and the second positioning plate of the second mounting seat of the base.

8. The replaceable skate assembly in accordance with claim 1, wherein the locking pawl of the locking device has a lower portion formed with a through hole for passage of the positioning rod of the locking device.

9. The replaceable skate assembly in accordance with claim 1, wherein the positioning rod is formed with an annular groove, and the locking device further includes a C-shaped snap ring secured in the annular groove of the positioning rod and located between the locking pawl and the first positioning plate of the second mounting seat of the base.

10. The replaceable skate assembly in accordance with claim 1, wherein the positioning rod has a distal end protruded outward from the base and formed with a screw bore, and the locking device further includes a screw screwed into the screw bore of the positioning rod.

11. The replaceable skate assembly in accordance with claim 1, wherein the spring is mounted on the positioning rod, and is urged between the first positioning plate and the second positioning plate of the second mounting seat of the base.

* * * * *